United States Patent [19]

Vasquez

[11] 4,311,198

[45] Jan. 19, 1982

[54] SMOKE REMOVAL APPARATUS WITH SUCTION OR BLOWING AND DIRECTIONAL DISCHARGE OPTIONS

[76] Inventor: Pete C. Vasquez, 1607 NW. 23rd St., Fort Worth, Tex. 76106

[21] Appl. No.: 106,700

[22] Filed: Dec. 26, 1979

[51] Int. Cl.[3] ..... A62C 27/28

[52] U.S. Cl. ..... 169/11; 169/24; 169/91

[58] Field of Search ..... 169/11, 24, 45, 52, 169/54, 70, 91; 98/6, 43 R, 54, 55, 115 VM; 239/587; 248/49, 80, 87

[56] References Cited

U.S. PATENT DOCUMENTS

| | | | |
|---|---|---|---|
| 667,149 | 1/1901 | Kenney | 169/91 |
| 1,849,411 | 3/1932 | Silva et al. | 169/91 X |
| 2,439,487 | 4/1948 | Reilly | 98/6 |
| 2,539,452 | 1/1951 | Mapes | 169/11 |
| 2,684,222 | 7/1954 | Miller | 248/49 |
| 2,857,005 | 10/1958 | Medlock | 169/70 X |
| 3,765,317 | 10/1973 | Lowe | 239/587 X |
| 3,817,161 | 6/1974 | Koplon | 169/91 X |
| 4,086,847 | 5/1978 | Overmyer | 98/115 VM |
| 4,169,571 | 10/1979 | Duggan | 248/49 |

*Primary Examiner*—Robert J. Spar
*Assistant Examiner*—Fred A. Silverberg
*Attorney, Agent, or Firm*—James C. Fails

[57] ABSTRACT

Apparatus for removing smoke from an enclosure characterized by a truck transporting a suction-blower unit that can suck or blow the smoke from an enclosure. Respective first and second conduits are connected alternatively and optionally with the suction and discharge side of the suction-blower unit for removing the smoke. Aperture engaging mechanism is connected at the free end of the first conduit. The second conduit has an adjustable head for pointing its opening in any direction. An inert gas injection mechanism is provided in conjunction with the suction-blower unit for replacing the smoke with an inert gas to squelch combustion. Also disclosed are specific preferred construction elements.

3 Claims, 5 Drawing Figures

SMOKE REMOVAL APPARATUS WITH SUCTION OR BLOWING AND DIRECTIONAL DISCHARGE OPTIONS

FIELD OF THE INVENTION

This invention relates to smoke exhausting apparatus for use at fires. More particularly, this invention relates to smoke removal apparatus for removing smoke from an enclosure such as a building or the like.

DESCRIPTION OF THE PRIOR ART

The prior art has seen the development of a wide variety of methods and apparatuses for removing smoke from an enclosure. These range from the early thermal-chimmey effects of the American Indian teepee through modern forced smoke exhaustion. Typical of the apparatuses are those described in the following United States Patents. U.S. Pat. No. 667,149 describes fire apparatus having a blower and draft tube for blowing the smoke from an enclosure. U.S. Pat. No. 1,874,573 describes apparatus employing an airplane propeller solidly mounted in a building or the like to create a draft for sucking smoke from a fire and forcing it out a plenum. U.S. Pat. No. 2,078,580 describes a smoke exhauster employing a horizontal aircraft engine driving a propeller for drawing smoke through a bottom opening and blowing it out the top. U.S. Pat. No. 2,348,455 describes a portable collaspible fume extractor having an exhaust fan. U.S. Pat. No. 2,480,441 describes a mechanical ventilator having an extensible chute and forced air blower. U.S. Pat. No. 2,564,971 describes apparatus for partitioning a hall at a stairwell with the capability of removing smoke selectively to reduce the dangers in a hotel or the like. U.S. Pat. No. 3,817,161 describes a smoke protection system for high rise building comprising an openable elevator that can be placed at a given floor to blow air into that floor and displace the smoke therefrom. U.S. Pat. No. 3,826,180 describes a ventilation fan system with smoke detector speed control. U.S. Pat. No. 4,054,084 describes a fire and smoke free stairway for use in the event of fire in high rise buildings. The smoke free condition is developed by a velocity pressure of the air through the fire doorway from the fire stairway each time the door is opened during evacuation and without the pressurizing the stairway significantly.

Thus, it can be seen that the art has become crowded; yet, no one has provided apparatus that has the following desirable features. Specifically, the apparatus should have the following capabilities not heretofore provided:

1. The ability to blow an inert gas that will not support combustion into an enclosure from which the smoke is being withdrawn;
2. It should have the ability to add a charcoal filter for removal of noxious gases, smoke and the like;
3. Should have a unit capable of developing either suction or pressure;
4. Should have the capability of adding an hydraulic boom to extend an extensible conduit means;
5. Should be able to add a plurality of hoses to be able to blow into more than one aperture, or window;
6. Should be able to provide more than one blower driven by the same engine;
7. Should have a blower that gives workers fresh air while inside the building if on pressure;

8. Should provide a gasket about the enclosure engaging means;
9. Should have a unit detachably mounted so that it can be dropped off at a site if necessary;
10. Should be able to provide an option of cooling the air as by water coolers on the inlet;
11. Should be operable in conjunction with a hydraulic manlift to facilitate using the hydraulic hose extender;
12. Should have the capability of providing a sensing probe in the exhaust duct to automatically let firemen know when temperature and air quality is safe entering the building; and
13. Should have the probe capability of allowing analysis of chemical composition of the exhaust gases.

SUMMARY OF THE INVENTION

Accordingly, it is an object of this invention to provide smoke removal apparatus that has one or more of the features delineated hereinbefore and not heretofore provided, thereby alleviating the deficiencies of the prior art.

It is a specific object of this invention to provide apparatus that has a plurality of the features delineated hereinbefore and not heretofore provided, thereby alleviating the deficiencies of the prior art.

These and other objects will become apparent from the descriptive manner hereinafter, particularly when taken in conjunction with the appended drawings.

In accordance with this invention there is provided apparatus for removing smoke from an enclosure comprising:

a. truck means for transporting the suction-blower unit;
b. a powered suction-blower unit carried by the truck means; the suction-blower being capable of developing either vacuum or pressure for removing the smoke in respective relative directions;
c. extensible conduit means for conducting fluid and connected at one end with a suction-blower unit;
d. means for connecting alternatively and optionally the extensible conduit means with the suction side of the suction-blower units for sucking smoke from an enclosure and with the discharge side of the suction-blower unit for blowing smoke from the enclosure;
e. aperture engaging means for engaging an aperture in a portion of the enclosure for creating a movement potential for removing the smoke from within the enclosure; the aperture engaging means being connected with the second end of the conduit means and adapted to engage the periphery of the aperture for minimizing fluid leakage; and
f. second conduit means for conducting fluid and connected at its first end with the suction-blower unit; the second conduit means having at its second end an adjustable head for pointing its opening in any direction, azimuth and elevation, at least above horizontal.

In preferred embodiments a gas injection means is provided to operate in conjunction with the suction-blower unit for replacing the smoke with an inert gas to squelch combustion; and the suction-blower unit is skid mounted to facilitate being left at a site if the truck is needed elsewhere or for transportation.

DESCRIPTION OF THE PREFERRED EMBODIMENTS

Figure 1:
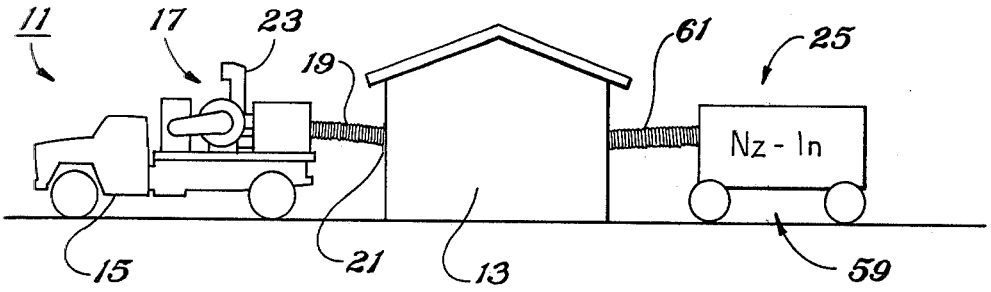
FIG. 1 is a schematic illustration showing the smoke removal apparatus of this invention.
Figure 5:
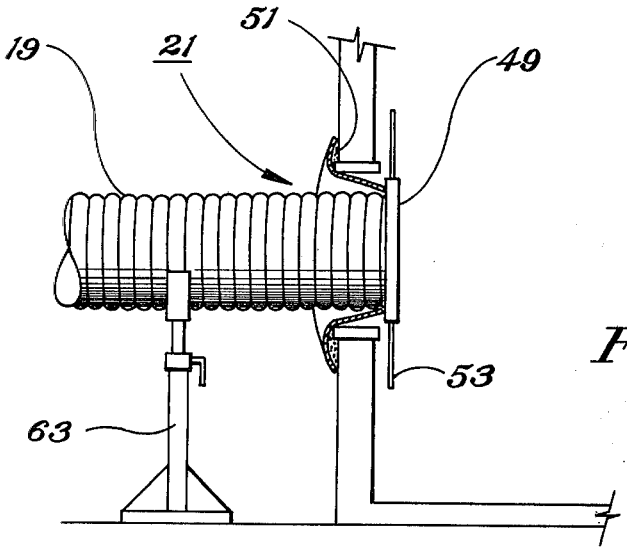
FIG. 5 is a partial side elevational view, partly in section, showing the second end of the extensible conduit means of FIG. 2 emplaced in a aperture in a wall of an enclosure for removing the smoke.

Referring to the Figs. and particularly FIG. 1, the apparatus 11 for removing smoke from an enclosure 13 comprises a truck means 15 for transporting suction-blower unit 17; extensible conduit means 19, aperture engaging means 21, FIG. 5, and second conduit means 23. As illustrated, the apparatus 11 also includes inert gas injection means 25 for operation in conjunction with the smoke removal apparatus for replacing the smoke with an inert gas to squelch combustion.

The enclosure 13 may comprise any type of enclosure ranging from dwellings to commercial buildings such as warehouses and the like through high rise buildings such as hotels, apartments and the like.

The apparatus 11 is widely in demand by fire chiefs around the country. It is needed to be portable and hence the emplacement on the truck means 15.

Figure 4:
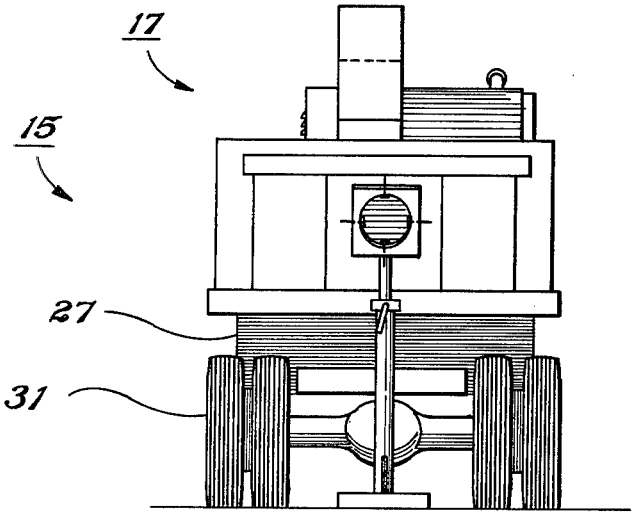
FIG. 4 is a rear view of the smoke removal means of FIG. 2.
Figure 3:
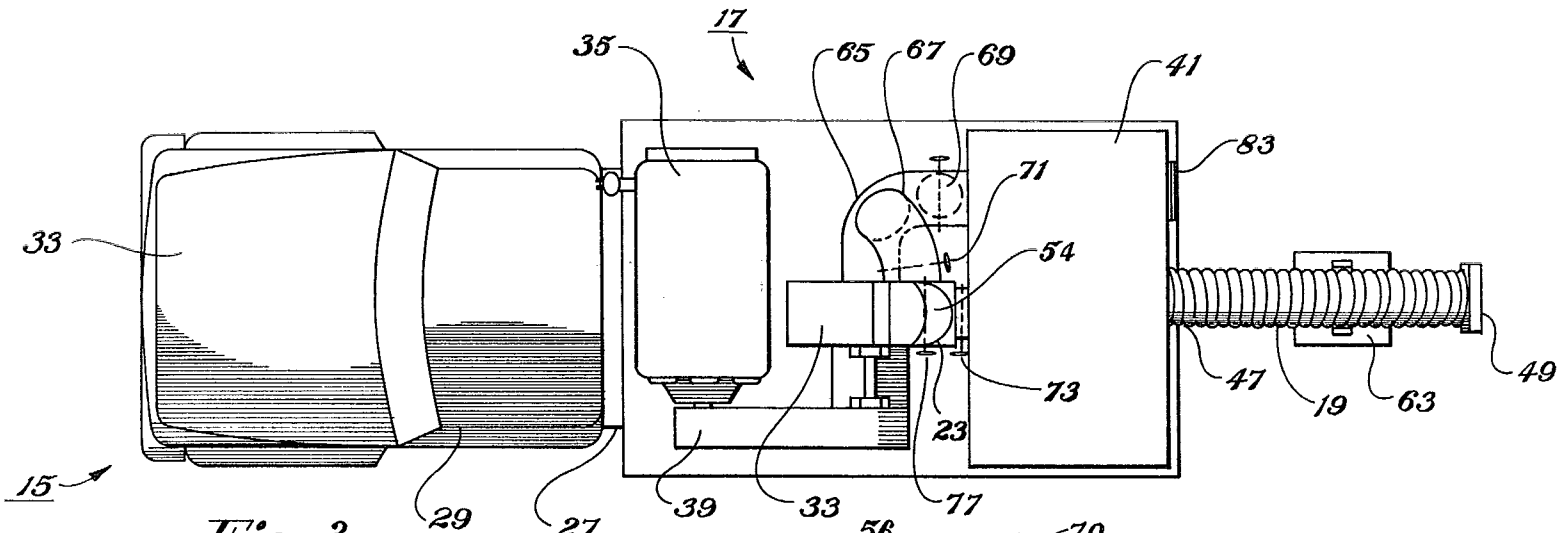
FIG. 3 is a top plan view of the smoke removal means of FIG. 2.
Figure 2:
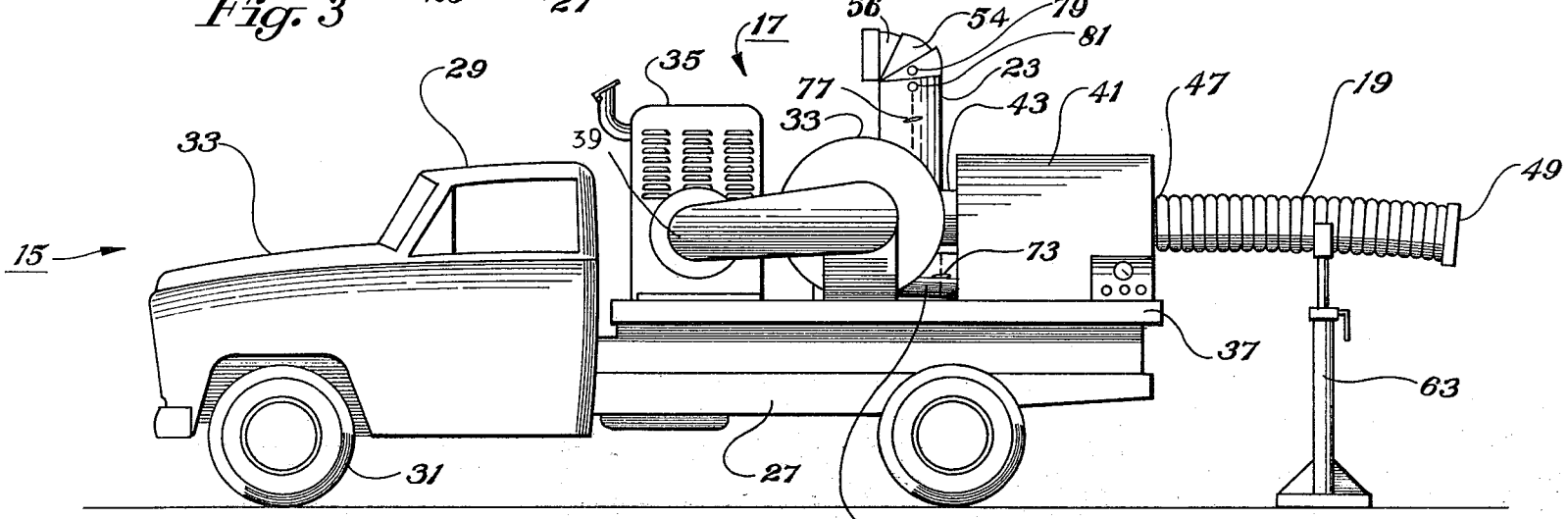
FIG. 2 is a side elevational view of the smoke removal means of FIG. 1.

The truck means 15, FIGS. 2–4, can comprise any of the satisfactory trucks having conventional chassis 27, cab 29 and wheels 31. The truck means 15 is powered by conventional internal combustion engine (not shown) under the hood 33. Suitable controls (not shown) are provided interiorly of the cab 29. The truck means 15 carries the powered suction-blower unit 17.

The suction-blower unit 17 comprises a blower unit 33 and a drivingly connected prime mover 35. As illustrated, the blower 33 is a centrifugal blower that takes suction near its center and provides a positive pressure above ambient atmosphere at its peripheral casing. Any of the conventional blowers that will develop relatively high suction, or a suction pressure that is significantly below atmospheric, and that will develop a relatively high discharge pressure above atmospheric can be employed. The blower may be designed for any particular capacity ranging from three to ten thousand cubic feet per minute. Even larger units may be employed for large high rise buildings. Ordinarily, such a blower comprises a centrifugal impeller that is rotated at a high rate of speed interiorly of the casing 33.

The prime mover 35 in the illustrated embodiment is an internal combustion engine, such as a disel, or gasoline-burning engine. An engine with a separate source is preferred rather than using the electrical power from the building or the like, since the electrical power may be interrupted in the event of a fire. Of course, separate electric motor with a prime mover driving a generator can be employed on the unit 17.

As illustrated, the prime mover 35 and the blower 33 are mounted on a side 37. This facilitates the pulling the unit from the truck and leaving it at the site to be used as necessary and allows using the truck for additional transportation purposes.

The prime mover 35 is drivingly connected with the blower 33 by way of several means. While any means including transmissions and the like can be employed, the illustrated means comprises respective sheaves on the output shaft of the prime mover 35 and the input shaft of the blower 33 connected by way of belts interiorly of the guard 39. The suction-blower unit includes an inhalation unit 41 that is connected by way of conduit means 43 at the suction side of the blower 33 and by way of conduit means 45 with the discharge side of the blower 33. The inhalation unit facilitates inclusion of additional elements; such as, charcoal filters and the like for removal of noxious gases and other purposes. The inhalation unit is placed intermediate the blower 33 and the first extensible conduit means 19.

First extensible conduit means 19 is provided for conducting fluid such as air, smoke, products of combustion and the like. It is connected at one end 47 with the suction-blower unit 17. Specifically, it is connected with the aperture on the inhalation unit 41. First extensible conduit means 19 may comprise a number of conduits that can be joined together or it may comprise a flexible conduit such as that formed from Owl-Flex type corrugated plastic hoses, or any combination. The diameter will be adequate to handle the volume of air to be moved by the blower 33. Consequently, the diameters may range from as little as six inches to as much as two to three feet or more. If desired, a plurality of quickly and easily connected and disconnected sections of flexible hose can be employed to enable reaching to heights, particulary when employed in conjunction with hydraulically extensible boom. Expressed otherwise, the free end 49 of the extensible hose may be connected with a hydraulic boom and raised to any desired height such as a window on an elevated floor. When employed with a hydraulic boom, it is preferred to also employ a hydraulically elevatable "crows nest" to enable an operator to control the extensible hydraulic boom and the placement of the free end 49 of the conduit means. The free end 49 preferably includes an aperture engaging means 21, FIG. 5. As illustrated, the aperture engaging means 21 includes foam rubber 51 or other resilant material to minimize the loss of fluids, such as air, smoke or the like. The aperture engaging means includes extensible members 53 for extending interiorly of the window for holding the free end 49 interiorly of the window if desired. If desired, the extensible member 53 can be automated so as to be extended hydraulically, or electrically by remote control. Such remote control is advantageous when the extensible conduit 19 is to be emplaced in windows at elevated floors or the like and is employed in conjunction with the hydraulically extensible boom.

The second conduit means 23 may comprise any suitable conduit means. As illustrated, it comprises a rigid conduit means that is satisfactory to provide suction or discharge. Expressed otherwise, the second conduit means 23 is a sheet metal, or plastic unit that carries a head 54. The head 54 is pivotally rotatable, or adjustable, so that it can be pointed at any azimuth. In addition, it is moveable to point it upwardly or through a particular elevation with respect to horizontal. Specifically, telescopingly pivotally mounted hood segments 56 are moveable to a desired elevational angle. This allows discharging the smoke in any desired azimuth and elevational orientation to get it out of the area and avoid risk of poisoning firemen or the like with noxious gases.

As illustrated, the inert gas injection means 25 is carried on a separate vehicle 59 such as a trailer or the like. It can be carried on a larger truck along with the suction-blower unit 17 if desired. Moreover, it can be a self propelled vehicle such as the truck means 15 if desired. As illustrated, the inert gas injection means 25 comprises a plurality of nitrogen containers for injecting nitrogen gas by way of conduit 61 into the enclosure 13. This replaces the smoke with inert nitrogen which will not support combustion and squelches any burning or combustion. Other inert gas that are not toxic and will not support combustion include carbon dioxide, neon, argon and the like. The latter are more expensive than nitrogen. The conduit 61 may comprise the same type of conduit employed in the first extensible conduit 19. Preferably it, also, has an aperture engaging means 21 to facilitate injection of the inert gas with minimal fluid loss.

As illustrated, an adjustable stand 63 is provided for supporting intermediate lengths of the first extensible conduit 19. If desired, it can be employed for supporting the conduit 61, also.

If desired, the inert gas may be injected into the suction side of the blower 33 and used to blow the smoke from the enclosure 13. This is effected by connecting the intake of the head 54 with the conduit 61.

To give the flexibility of either sucking the smoke from the enclosure or blowing the smoke from the enclosure, it is preferred that a plurality of valve means be employed. Specifically, the conduit 65 that is connected to the suction side of the blower 33 is able to take smoke from the inhalation unit 41 or take fresh air or inert gas from the second conduit 23. This arrangement is possible because of the interconnecting conduits 67 and respective damper valves 69, 71. Specifically, as illustrated, the damper valve 69 is opened to allow the blower to take suction from the inhalation unit 41. If, on the other hand, the valve damper 69 were closed and the valve damper 71 opened, the suction would be taken from the second conduit 23.

Conversely, the discharge side of the blower 33 is connected with the second conduit 23; but has a second discharge conduit 45 for connecting with the inhalation unit 41. Respective damper valves 73 and 77 enable discharging the gaseous fluid respectively into the inhalation unit 41 or to the second conduit 23. As illustrated, the damper valve 73 is closed so as to block flow into the inhalation unit 41 and the damper valve 77 is opened to allow discharge out the second conduit 23. When the gas is discharged out the second conduit 23, it sometimes is desirable to sample the gases for temperature and for chemical content. Suitable probe openings 79, 81 are provided for inserting a temperature probe or a gas analysis probe. This enables telling the firemen when it is safe to enter the enclosure, such as a burning building.

In operation, the apparatus 11 is assembled as described hereinbefore. Upon sounding of an alarm, such as a call from a fireman for smoke removal from a building, the unit is driven to the situs of the fire. The free end 49 is inserted into an aperture, such as a window or the like. The extensible members 53 can be extended if desired. Thereafter, the prime mover 35 is started, starting rotation of the blower 33. If it is desired to suck the smoke from the building the valves are so positioned as to suck the smoke into the inhalation unit 41 and discharge it through the second conduit 23. Once the smoke is clear the firemen can then enter the building to insure that the flames are stopped or otherwise correct the malfunction. If desired, the inert gas, such as nitrogen, can be injected by way of the inert gas injection unit 25 at an appropriate point, such as opposite the point of withdrawal of the smoke.

If, on the other hand, it is desired to blow the smoke from the building, the valving can be set to such that suction is taken through the second conduit 23 and discharged through the inhalation unit 41 and the first extensible conduit means 19 into the building. The blowing may be by way of air or, if it is desired to squelch combustion by way of an inert gas such as nitrogen from the nitrogen injection unit 25. As indicated, this is effected by connecting the conduit means 61 with the suction head 54.

If an elevated floor is desired to have smoke removed therefrom, suitable hydraulically operable carriers and hydraulically extensible booms will be employed. Ordinarily, these are readily available as separate mobile units. If desired, of course, they can be incorporated onto the truck means 15, but this encumbers the truck means. It is readily and easily adjusted by connecting a plurality of sections of the first extensible conduit means 19 and connecting the free end 49 to the hydraulically extensible boom. Otherwise the operation is carried out as described hereinbefore.

If desired, a water cooled evaporative type cooler can be employed on the suction side of the unit as by connection with the second conduit 23 if cooled air is to be blown into the building. Similarly, fresh air or high quality air can be employed to give workers fresh air while they are inside the building. If desired, a plurality of units may be connected with the inhalation unit 41 either by way of Y connections onto the aperture to which the end 47 is connected or by a plurality of apertures such as capped aperture 83, FIG. 3, to enable going through a plurality of first extensible conduits 19. Moreover, additional blowers can be employed by the simple expedient of connecting onto the blower shafts or by respective sheaves and belt arrangements from the prime mover 35.

From the foregoing it can be seen that this invention enables achieving the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and scope of the invention, reference for the latter being had to the appended claims.

I claim:

1. Apparatus for removing smoke from an enclosure, comprising:

a. truck means for transporting a suction-blower unit;

b. a powered suction-blower unit carried by said truck means; said suction-blower unit also including an inhalation unit and having a capability of creating a suction below atmospheric at its suction side and having a capability of creating pressure above atmospheric at its discharge side;

c. extensible first conduit means for conducting a fluid and connected at one end with said suction-blower unit;

d. a second conduit and a third conduit having respective valves therein for connecting alternatively and optionally said extensible conduit means with the suction side of said suction-blower unit for sucking smoke from said enclosure and with the discharge side of said suction-blower unit for blowing smoke from said enclosure, said second conduit being connected to the suction side of the suction-blower unit to withdraw smoke from the inhalation unit or withdraw fresh air or inert gas from a fourth conduit by the positioning of the valves in the second conduit, said third conduit being connected to the discharge side of the suction-blower unit to discharge gaseous fluid into the inhalation unit or to the fourth conduit by the positioning of the valves in the third conduit;

e. aperture engaging means for engaging an aperture in a portion of said enclosure for creating a movement potential for moving said smoke from within said enclosure; said aperture engaging means being connected with another end of said extensible first conduit means and adapted to engage the periphery of said aperture for minimizing fluid leakage; and f. said fourth conduit connected at its first end with said suction-blower unit; said fourth conduit having at its second end an adjustable head that is pivotally mounted and adapted for pivotal movement about a vertical axis and in the horizontal plane to a desired azimuth and angularly adjustable with respect to horizontal for pointing its discharge opening in any direction, azimuth and elevation, at least above horizontal.

2. The apparatus of claim 1 wherein an inert gas injection means is provided to operate in conjunction with said suction-blower unit for replacing said smoke with an inert gas to squelch combustion.

3. The apparatus of claim 1 wherein a stand is provided to support said extensible conduit means.

* * * * *